US009692197B2

(12) United States Patent
Zou et al.

(10) Patent No.: US 9,692,197 B2
(45) Date of Patent: Jun. 27, 2017

(54) METHOD FOR MANUFACTURING A COMMUTATOR USING A BRAZING AND SOLDERING PROCESS

(71) Applicants: Johnson Electric S.A., Murten (CH); Shenzhen Joint Welding Material Co., Ltd., Shenzhen (CN)

(72) Inventors: Zhiping Zou, Shenzhen (CN); Jianjun Guo, Shenzhen (CN); Chihang To, Hong Kong (CN); Zonghui Zheng, Shenzhen (CN)

(73) Assignees: JOHNSON ELECTRIC S.A., Murten (CH); SHENZHEN JOINT WELDING MATERIAL CO. LTD., Shenzhen (CN)

( * ) Notice: Subject to any disclaimer, the term of this patent is extended or adjusted under 35 U.S.C. 154(b) by 549 days.

(21) Appl. No.: 14/221,163

(22) Filed: Mar. 20, 2014

(65) Prior Publication Data

US 2014/0285059 A1 Sep. 25, 2014

(30) Foreign Application Priority Data

Mar. 20, 2013 (CN) ..... 2013 1 0091498

(51) Int. Cl.
*H01R 43/06* (2006.01)

(52) U.S. Cl.
CPC ..... *H01R 43/06* (2013.01)

(58) Field of Classification Search
CPC ..... H02K 13/006; H02K 12/10; H02K 13/10; H02K 9/28; H01R 43/06
USPC ..... 310/219–252
See application file for complete search history.

(56) References Cited

U.S. PATENT DOCUMENTS

2003/0052564 A1* 3/2003 Wilsdorf ..... H01R 39/24 310/179
2009/0179519 A1* 7/2009 Poon ..... H01R 39/06 310/237

FOREIGN PATENT DOCUMENTS

CN 101098064 A 1/2008
WO 2008/043273 A1 4/2008

* cited by examiner

*Primary Examiner* — Naishadh Desai
(74) *Attorney, Agent, or Firm* — Muncy, Geissler, Olds & Lowe, P.C.

(57) ABSTRACT

A commutator (10) comprising a plurality of commutator bars (12) formed from a graphite structure (30) and a metal sheet (20) having soldered to the graphite structure (30) includes a brazing process followed by a soldering process. The brazing process includes applying a brazing material the graphite structure (30) and brazing at an elevated temperature to form a brazing layer (40). The soldering process includes applying a solder material to the brazing layer (40), placing the metal sheet (20) on the solder material, and soldering to form a solder layer (50) affixing the metal sheet (20) to the graphite structure (30). A plurality of grooves (70) are cut in the graphite structure (30) and the metal sheet (20) to form the commutator bars (12) arranged in an intermittent ring or circle.

14 Claims, 6 Drawing Sheets

METHOD FOR MANUFACTURING A COMMUTATOR USING A BRAZING AND SOLDERING PROCESS

CROSS REFERENCE TO RELATED APPLICATION(S)

This application claims the benefit of Chinese patent application serial no. 201310091498.2, filed on Mar. 20, 2013. The entire content of the aforementioned patent application is hereby incorporated by reference for all purposes.

BACKGROUND

A commutator for an electric motor typically comprises a plurality of commutator bars electrically connected to a plurality of hooks, wherein the hooks are used to mount one or more coils, so that the coils are electrically connected to the commutator. In many commutators, the commutator bars and hooks are integrally formed from a stamped copper sheet. However, in electric motors using carbon brushes, the hardness of the carbon brush is much less than that of the copper commutator bars and hooks, which leads to increased wear and tear on the carbon brushes during motor operation.

To address this problem, some commutators use graphite in place of copper in the commutator bars. However, this may create problems when connecting the graphite commutator bars to the copper hooks. In the current industry, a nickel or copper metal layer is formed on the surface of the graphite bars through electroplating or ion sputtering. Subsequently, a solder material having a melting point of 450 degrees Celsius (° C.) or less, such as tin, is used to solder a copper sheet comprising the plurality of hooks to the metal layer on the graphite bars. However, due to there being no metallurgical bond between the metal layer and graphite bar, the connection between the metal layer and graphite bars in commutators manufactured using this method lack sufficient strength.

Alternatively, a brazing material with a melting point of 450° C. or higher is applied between the graphite bars and the copper sheet, where the graphite bars, copper sheet, and brazing material are placed in a high temperature furnace and brazed, fixing the copper sheet to the graphite bar. However, due to the large differences of coefficient of thermal expansion between copper and graphite, the brazing process may cause many large cracks to form in the graphite. In addition, the copper of the copper sheet may be weakened or softened by the high temperature brazing process, making it less suitable for mounting the coils.

Accordingly, there exists a need for a method for manufacturing a commutator that addresses the above problems.

SUMMARY

Some embodiments are directed at method for manufacturing a commutator for an electric motor having graphite bars. In some embodiments, the commutator bars of the commutator comprise a graphite layer and a metal layer, connected by a brazing layer and a solder layer. In some embodiments, a brazing material is applied to a surface of a graphite structure and brazed to form a brazing layer. Subsequently, a solder material is applied to the brazing layer, and used to solder the brazing layer to a metal sheet. A plurality of grooves formed in the graphite structure and metal sheet divide the graphite structure and metal sheet into a plurality of commutator bars.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered which are illustrated in the accompanying drawings. These drawings depict only exemplary embodiments and are not therefore to be considered limiting of the scope of the claims.

DETAILED DESCRIPTION

Figure 1A:
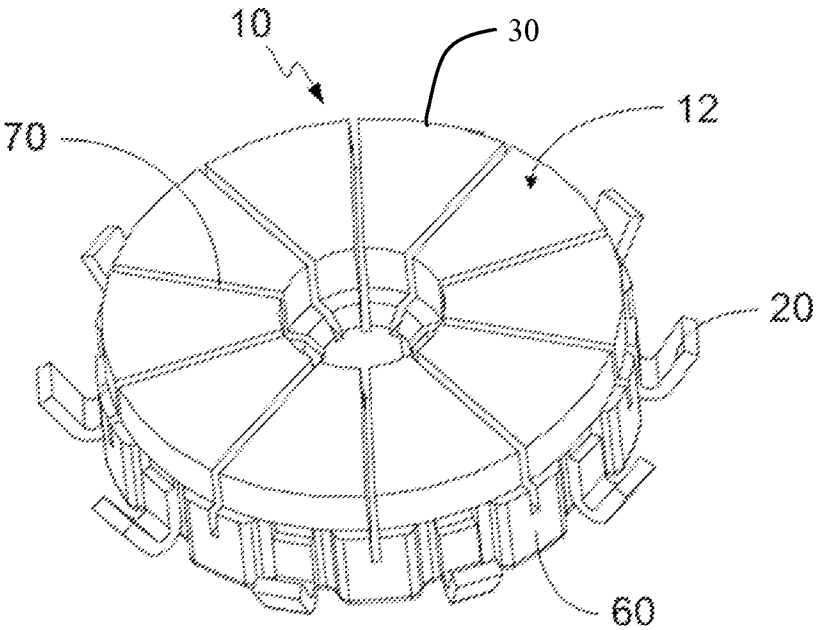
FIGS. 1A and 1B illustrate a commutator in accordance with some embodiments.

Various features are described hereinafter with reference to the figures. It shall be noted that the figures are not necessarily drawn to scale, and that the elements of similar structures or functions are represented by like reference numerals throughout the figures. It shall also be noted that the figures are only intended to facilitate the description of the features for illustration and explanation purposes, unless otherwise specifically recited in one or more specific embodiments or claimed in one or more specific claims. The drawings figures and various embodiments described herein are not intended as an exhaustive illustration or description of various other embodiments or as a limitation on the scope of the claims or the scope of some other embodiments that are apparent to one of ordinary skills in the art in view of the embodiments described in the Application. In addition, an illustrated embodiment need not have all the aspects or advantages shown.

An aspect or an advantage described in conjunction with a particular embodiment is not necessarily limited to that embodiment and may be practiced in any other embodiments, even if not so illustrated, or if not explicitly described. Also, reference throughout this specification to "some embodiments" or "other embodiments" means that a particular feature, structure, material, process, or characteristic described in connection with the embodiments is included in at least one embodiment. Thus, the appearances of the phrase "in some embodiments", "in one or more embodiments", or "in other embodiments" in various places throughout this specification are not necessarily referring to the same embodiment or embodiments.

Some embodiments are directed at method for manufacturing a commutator for an electric motor having a graphite base structure. In some embodiments, the commutator bars of the commutator comprise a graphite layer and a metal layer. In some embodiments, a brazing material is applied to a surface of a graphite structure and brazed to form a brazing layer. Subsequently, a solder material is applied to the brazing layer, and used to solder a metal sheet to the brazing layer. A plurality of grooves are formed in the graphite structure and metal sheet such that the graphite structure and metal sheet are divided into a plurality of commutator bars, which may be arranged in an intermittent ring or circle.

Figure 1B:
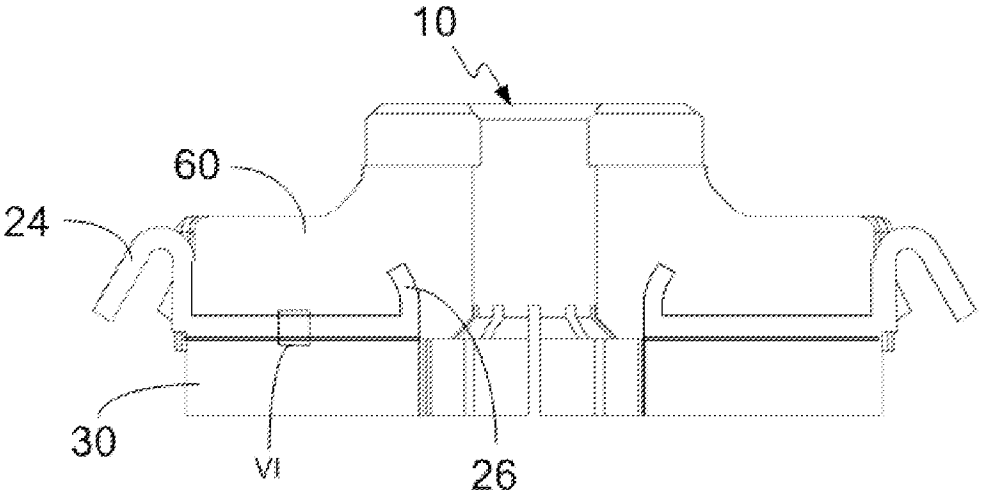

FIGS. 1A and 1B illustrates a commutator 10 in accordance with some embodiments. Commutator 10 comprises a metal sheet 20 formed into a plurality of hooks, and a carbon or graphite structure 30 (hereinafter graphite structure 30) on one side of metal sheet 20. In addition, commutator 10 may comprise an insulating layer 60 on the opposite side of metal sheet 20 from graphite structure 30. Graphite structure 30 and metal sheet 20 are divided by a plurality of grooves 70 into a plurality of sections insulated from each other to form a plurality of commutator bars 12. Commutator bars 12 may be arranged in the form of an intermittent ring or circle.

Figure 2:
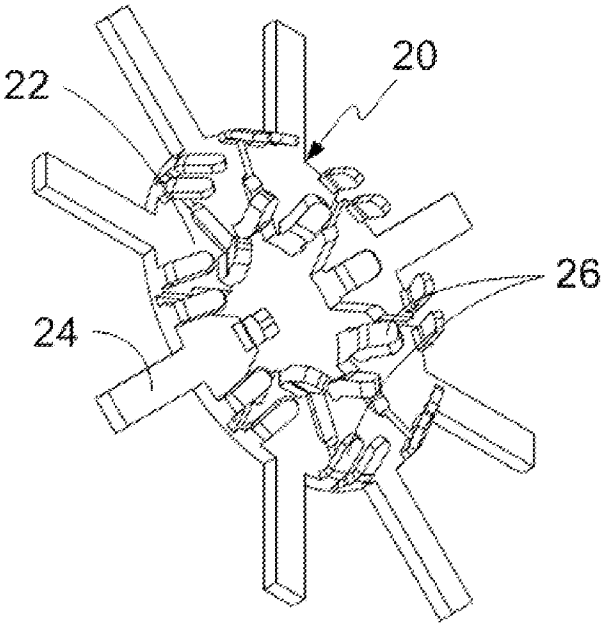
FIG. 2 illustrates a metal sheet used in a commutator in accordance with some embodiments.

FIG. 2 illustrates a metal sheet 20 used in commutator 10 in accordance with some embodiments. Metal sheet 20 comprises a central ring 22, a plurality of protrusions 24 extending outwards from the outer edge of central ring 22, and a plurality of projections 26 extending in a substantially axial direction along the inner and outer edges of central ring 22. In some embodiments, projections 26 are not perfectly axial, but are configured to be slightly inclined towards each other.

In a preferred embodiment, each protrusion 24 is located between two outer-edge projections 26, and faces an inner-edge projection 26. In some embodiments, projections 26 are enclosed or embedded within insulating layer 60 to securely connect insulating layer 60 to metal sheet 20. During assembly of commutator 10, protrusions 24 are bent to form a plurality of hooks.

Figure 4A:
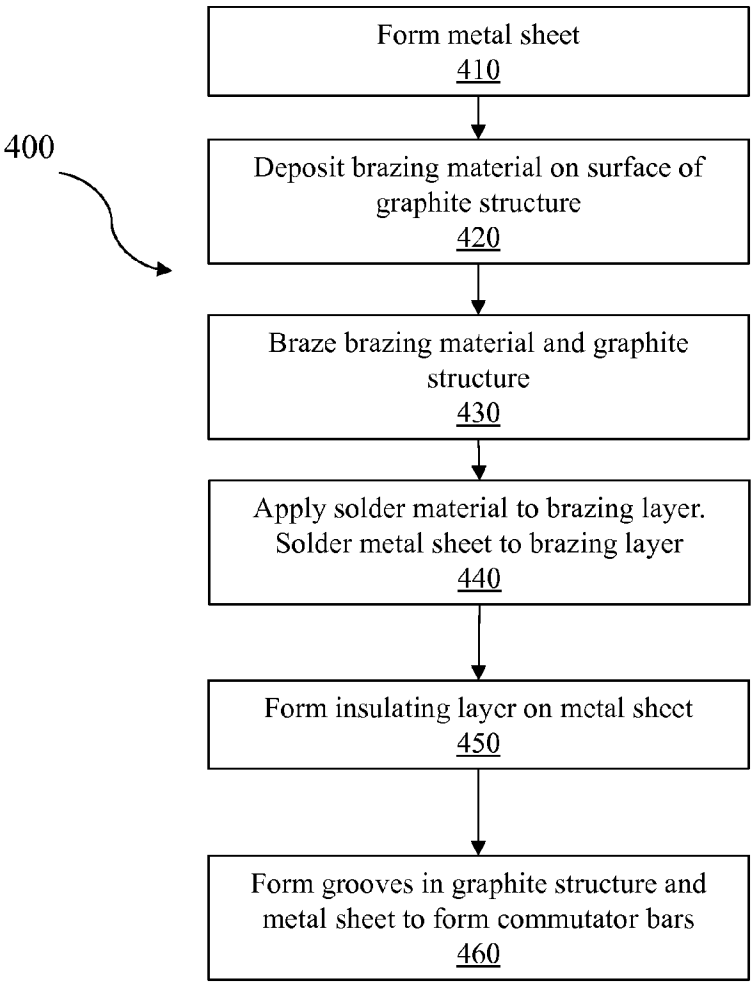
FIGS. 4A and 4B are flowcharts illustrating a process for manufacturing a commutator in accordance with some embodiments.

FIG. 4A is a flowchart illustrating a process 400 of manufacturing a commutator, such as, for example, commutator 10 shown in FIGS. 1A and 1B, in accordance with some embodiments. Process 400 starts at 410, metal sheet 20 by punching or pressing. In various embodiments, metal sheet 20 may be made of copper, silver, aluminum, or other types of metals.

At 420, a brazing material is applied to a surface of graphite structure 30. The brazing material may be applied through screen printing or spraying. In some embodiments, graphite structure 30 is cleaned prior to applying the brazing material. The cleaning process may comprise one or more of the following: grinding the surface of graphite structure 30 that is to receive the brazing material, washing graphite structure 30 using alcohol and a means for generating ultrasonic waves, immersing graphite structure 30 in acetone, and/or drying graphite structure 30.

Subsequently at 430, the graphite structure 30 with brazing material applied thereon is brazed. In some embodiments, brazing may be done using a vacuum furnace. The vacuum furnace may be configured to have a vacuum degree of $1.0\times10^{-1}$ Pascals (Pa) or higher (e.g., $1.0\times10^{-3}$ Pa), and a temperature of 800 degrees Celsius (° C.) or higher, wherein graphite structure 30 and brazing material are placed in the furnace for a period of between 10 minutes and 30 minutes. However, it is understood that in some embodiments, the brazing period may exceed 30 minutes. It is understood that in other embodiments, brazing may done in other types of furnaces.

Figure 3:
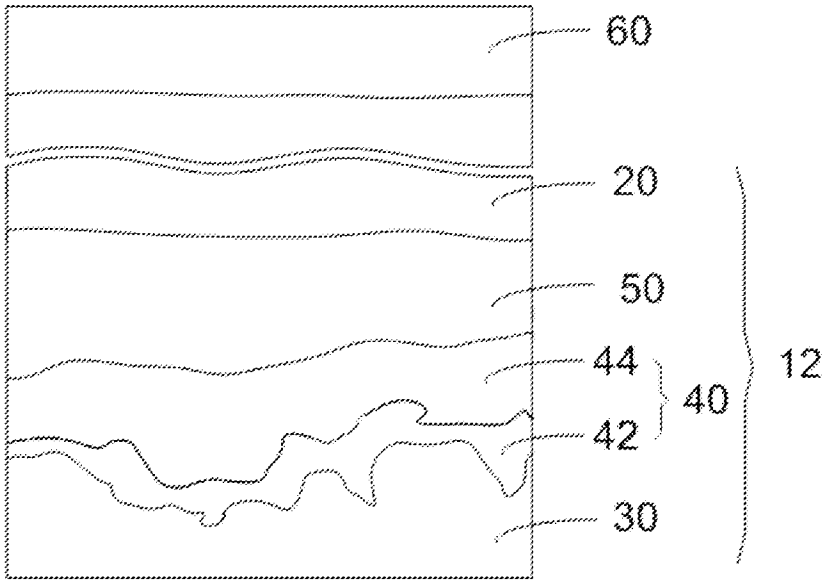
FIG. 3 illustrates a cross-section of a commutator in accordance with some embodiments.

FIG. 3 illustrates a cross section of commutator 10 along the IV plane (illustrated in FIG. 1B) after brazing. The applied brazing material forms a brazing layer 40 over graphite structure 30.

Figure 4B:
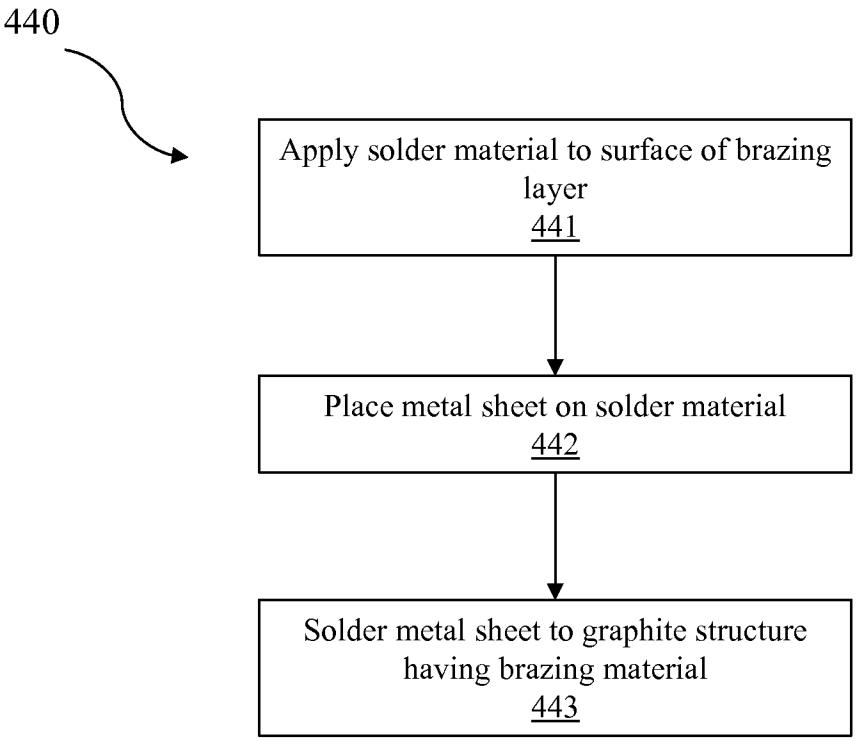

At 440, metal sheet 20 is soldered to a surface of the brazing layer 40 on brazed graphite structure 30. FIG. 4B is a flowchart illustrating a soldering process that may correspond to soldering step 440 in flow chart 400 in accordance with some embodiments. At 441, a solder material is applied on a surface of brazing layer 40 on brazed graphite structure 30. In some embodiments, the solder material may be in the form of a paste, powder, or slurry, and be applied to brazing layer 40 through screen printing. In other embodiments, the solder material is a solid piece or sheet placed on a surface of metal sheet 20, with a shape corresponding to that of the surface of metal sheet 20.

Subsequently at 442, metal sheet 20 is placed on top of the solder material. In some embodiments, metal sheet 20 is placed such that the surface of metal sheet 20 without projections 26 faces the applied layer of solder material over brazing layer 40 of graphite structure 30.

At 443, graphite structure 30 having brazing layer 40, the solder material, and metal sheet 20 are placed in a soldering environment for certain amount of time. In some embodiments, the soldering environment is configured to have a temperature between 130° C. and 350° C., and the amount of time is configured to be between 2 minutes and 10 minutes. Thus, metal sheet 20 is soldered to brazing layer 40 of graphite structure 30 with a solder layer 50 formed between metal sheet 20 and brazing layer 40, as shown in FIG. 3.

While FIG. 4B illustrates a particular soldering process 440 that may be used in some embodiments, it is understood other types of soldering processes may be used instead in various other embodiments. For example, metal sheet 20 may be soldered to graphite structure 30 through a hand soldering process using an electric iron.

Referring back to FIG. 4A and at 450, an insulating layer 60 is formed on a surface of metal sheet 20 opposite to solder layer 50 (e.g., the side of metal sheet 20 having projections 26). Insulating layer 60 comprises an insulating material such as plastic, and may be formed through an injection molding process. In some embodiments, projections 26 are enclosed or embedded within insulating layer 60, firmly securing metal sheet 20 to plastic layer 60. Protrusions 24 may be bent into a hook shape as illustrated in FIGS. 1A and 1B, allowing for coils to be mounted.

Subsequent at 460, graphite structure 30 with metal sheet 20 soldered thereto is divided into a plurality of commutator bars 12 of commutator 10. In some embodiments, this is done by forming a plurality of grooves 70 on graphite structure 30 and metal sheet 20. Grooves 70 may be formed by milling. Thus, graphite structure 30, brazing layer 40, solder layer 50, and metal sheet 20 are divided into a plurality of separate sub-sections that are insulated from each other, wherein the sub-sections form the commutator bars 12 of commutator 10, held together by insulating layer 60.

Referring to FIG. 3, after the brazing material and graphite structure 30 are brazed in step 430, active elements in the brazing material (such as titanium, chromium, zirconium, and/or silicon) will undergo chemical reactions with the carbon element on the surface of graphite structure 30, forming brazing layer 40 the surface of graphite structure 30. Brazing layer 40 comprises two layers: a reaction layer 42 adjacent to an interior of graphite structure 30, formed by chemical reactions between the brazing material and carbon of graphite structure 30, and a binding layer 44 near the surface of graphite structure 30 formed mostly of the brazing material through a thermal process.

Due to metallurgical reactions, reaction layer 42 is tightly bound to the carbon in graphite structure 30 and to binding layer 44, which comprises predominantly metal elements. Thus, the brazed brazing material on the surface of graphite structure 30 forms a strong metal layer 42 strongly bonded to the carbon graphite structure 30 through chemical reactions and bonding layer 44 tightly bonded to reaction layer 42, thereby metalizing the surface of graphite structure 30 and facilitating the subsequent binding of metal layer 20 to graphite structure 30 by soldering in step 440.

In addition, because metal sheet 20 is soldered to brazing layer 40 in a comparatively lower temperature environment, the process does not soften metal sheet 20, and avoids the formation of cracks in graphite structure 30 that would otherwise formed due to the large difference in coefficients of thermal expansion between the metal of metal sheet 20 and the graphite of graphite structure 30.

Various specific embodiments are described herein below. In various embodiments, different materials and configurations may be used. It is understood the following embodiments are meant to illustrate, and are not intended the limit the scope of the claims.

Embodiment 1

In a first embodiment, metal sheet 20 is made of copper, while the brazing material includes a titanium-copper-silver mixture. For example, the brazing material mixture may comprise by weight approximately 69% silver, 27% copper, and 4% titanium. The brazing material is applied to graphite structure 30 using silk screen printing. The silk screen printing process preferably uses a polyester mesh having a thickness of 0.5 millimeters (mm) or less, such that the mesh will be able to exhibit desirable elasticity during the printing process.

At 430, in accordance with the first embodiment, graphite structure 30 having the brazing material is placed in a vacuum furnace configured to have a vacuum degree between $1.0\times10^{-1}$ Pa and $4.0\times10^{-2}$ Pa, and a temperature between 800° C. and 900° C., for a period of time between 13 minutes and 17 minutes. In a preferred embodiment, the vacuum furnace is configured to have a vacuum degree of approximately $6.0\times10^{-2}$ Pa, a temperature of 850° C., and a furnace time of 15 minutes. In some embodiments, upon placement of graphite structure 30 in the furnace, the temperature of the furnace is configured to rise at rate of approximately 10° C. per minute until the target temperature of 850° C. is reached. The temperature in the furnace is maintained at the target temperature for the furnace time (e.g., 15 minutes). Graphite structure 30 is subsequently cooled.

The solder material used at 440 comprises a tin paste applied to the surface of brazing layer 40 through screen printing. The screen printing process preferably uses a steel mesh screen having a thickness of 1 mm or less, in order to achieve the desirable flexibility of the mesh during the printing of the solder material. The brazed graphite structure 30, paste, and copper sheet 20 are placed in a soldering environment with a temperature of between 250° C. and 350° C. for a period of time between 2 minutes and 4 minutes, and subsequently cooled. Thus copper sheet 20 is soldered to the surface of brazing layer 40, with the solder paste forming solder layer 50.

The remaining process steps of the first embodiment are the same as those illustrated in FIG. 4A, and would not be specifically described here.

Embodiment 2

In a second embodiment, metal sheet 20 is made of copper, and the brazing material is a $BNi_2$ type brazing material in accordance with American Welding Society (AWS) guidelines applied using a spraying method.

At 430, graphite structure 30 comprising the layer of $BNi_2$ type brazing material is placed in a vacuum furnace for between 25 minutes and 35 minutes, wherein the furnace is configured to have a vacuum degree between $2.0\times10^{-2}$ Pa and $8\times10^{-3}$ Pa and a temperature between 1050° C. and 1150° C. In a preferred embodiment, the vacuum degree and temperature of the furnace are configured to be $1.00\times10^{-2}$ Pa and 1100° C., respectively, and graphite structure 30 is placed in the furnace for 30 minutes. In some embodiments, upon placement of graphite structure 30 within the furnace, the temperature of the furnace is configured to rise at rate of approximately 15° C. per minute until the target temperature of 1100° C. is reached, upon which the furnace time of 30 minutes begins. Graphite structure 30 is subsequently cooled.

At 440, a solder paste comprising a slurry of tin (Sn) and bismuth (Bi) is applied to brazing layer 40. In some embodiments, the tin-bismuth slurry comprises by weight approximately 42% tin and 58% bismuth (Sn-58Bi). The solder paste may be applied through screen-printing, which preferably uses a steel mesh screen having a thickness of 1 mm or less, in order to achieve desirable flexibility of the mesh during printing.

The brazed graphite structure 30, paste, and copper sheet 20 are placed in a soldering environment with a temperature of between 150° C. and 250° C. for between 4 minutes and 6 minutes, and subsequently cooled. Thus copper sheet 20 is soldered to the surface of brazing layer 40, with the solder paste forming a solder layer 50.

The remaining process steps of the second embodiment are the same as those illustrated in FIG. 4A, and would not be specifically described here.

Embodiment 3

In a third embodiment, metal sheet 20 comprises silver, and the brazing material may comprise titanium, zirconium, copper, and nickel uniformly sprinkled on a surface of graphite structure 30. In some embodiments, the brazing material comprises by weight approximately 40% titanium, 20% zirconium, 20% copper, and 20% nickel.

At 430, graphite structure 30 comprising the layer of brazing material is placed in a vacuum furnace for between 20 and 30 minutes, wherein the furnace is configured to have a pressure between $1.0\times10^{-2}$ Pa and $3\times10^{-3}$ Pa and a temperature between 900° C. and 1000° C. In a preferred embodiment, the pressure is configured to be $8\times10^{-3}$ Pa and the temperature to be 950° C., wherein graphite structure 30 having the brazing material is placed in the furnace for 20 minutes. In some embodiments, upon placement of graphite structure 30 within the furnace, the temperature of the furnace is configured to rise at rate of approximately 15° C. every minute until 950° C. is reached, upon which the furnace time of 30 minutes begins.

At 440, a solder piece with a shape corresponding to that of graphite structure 30 is placed over brazing layer 40. The use of a solid solder piece may allow for ease of assembly. The solder piece may comprise tin and copper, such as 98% tin, 2% copper (Sn-2Cu).

The brazed graphite structure 30, solder piece, and silver sheet 20 are placed in a soldering environment with a temperature of between 300° C. and 350° C. for between 7 minutes and 10 minutes, and subsequently cooled. Thus silver sheet 20 is soldered to the surface of brazing layer 40, with the solder paste forming a solder layer 50.

Embodiment 4

In a fourth embodiment, metal sheet 20 is made of aluminum. A $BNi_2$ type brazing material in accordance with AWS guidelines is used. The brazing material may be applied to graphite structure 30 using silk screen printing. The silk screen printing process preferably uses a polyester mesh having a thickness of 0.5 mm or less, such that the mesh will be able to exhibit better elasticity during the printing process.

At 430, graphite structure 30 comprising the layer of $BNi_2$ type brazing material is placed in a vacuum furnace for between 25 minutes and 35 minutes, wherein the furnace is configured to have a vacuum degree between $3.0\times10^{-3}$ Pa and $1.0\times10^{-3}$ Pa and a temperature between 1100° C. and 1200° C. In a preferred embodiment, the vacuum degree is configured to be $1.0\times10^{-3}$ Pa and the temperature to be 1200° C., wherein graphite structure 30 having the brazing material is placed in the furnace for 20 minutes. In some embodiments, upon placement of graphite structure 30 in the furnace, the temperature of the furnace is configured to rise at rate of approximately 20° C. per minute until 1200° C. is reached, upon which the furnace time of 20 minutes begins.

At 440, a solder piece with a shape corresponding to that of graphite structure 30 is placed over brazing layer 40. The use of a solid solder piece may allow for ease of assembly compared to applying a solder paste or slurry. The solder piece may comprise tin and copper, such as a 98% tin, 2% copper (Sn-2Cu).

The brazed graphite structure 30, paste, and aluminum sheet 20 are placed in a soldering environment with a temperature of between 270° C. and 300° C. for between 3 and 5 minutes, and subsequently cooled. Thus aluminum sheet 20 is soldered to the surface of brazing layer 40, with the solder paste forming a solder layer 50.

Embodiment 5

In a fifth embodiment, metal sheet 20 comprises copper. The brazing material is a $BNi_7$ brazing material in accordance with AWS guidelines, which is deposited on a surface of graphite structure 30 using screen printing, wherein the screen printing process preferably uses a polyester mesh having a thickness of 0.5 mm or less.

Graphite structure 30 having $BNi_7$ brazing material applied thereon is placed in an ammonia decomposition mesh belt furnace, with a belt speed of 1-8 meters per second (m/s), and a maximum temperature of between 800° C. and 1000° C. In a preferred embodiment, the belt speed of the mesh belt furnace is configured to be approximately 0.4 m/s, and the maximum temperature to be 1000° C. In some embodiments, the mesh belt furnace is a protective atmosphere or controlled atmosphere furnace. The protective atmosphere may include nitrogen, hydrogen, argon, helium, carbon monoxide, carbon dioxide, or a mixture of thereof, wherein different gases may correspond to different temperatures. Thus it is understood that temperature range is not limited to that described above.

At 440, a solder piece with a shape corresponding to that of graphite structure 30 is placed over brazing layer 40. The use of a solid solder piece may allow for ease of assembly compared to applying a solder paste or slurry. The solder piece may comprise tin and indium, such as a 49% tin, 51% indium (Sn-51In).

The brazed graphite structure 30, paste, and copper sheet 20 are placed in a soldering environment with a temperature of between 130° C. and 230° C. for between 3 and 5 minutes, and subsequently cooled. Thus copper sheet 20 is soldered to the surface of brazing layer 40, with the solder paste forming a solder layer 50.

In the foregoing specification, various aspects have been described with reference to specific embodiments thereof. It will, however, be evident that various modifications and changes may be made thereto without departing from the broader spirit and scope of various embodiments described herein. For example, the above-described systems or modules are described with reference to particular arrangements of components. Nonetheless, the ordering of or spatial relations among many of the described components may be changed without affecting the scope or operation or effectiveness of various embodiments described herein. In addition, although particular features have been shown and described, it will be understood that they are not intended to limit the scope of the claims or the scope of other embodiments, and it will be clear to those skilled in the art that various changes and modifications may be made without departing from the scope of various embodiments described herein. The specification and drawings are, accordingly, to be regarded in an illustrative or explanatory rather than restrictive sense. The described embodiments are thus intended to cover alternatives, modifications, and equivalents.

The invention claimed is:

1. A method for manufacturing a commutator for an electric motor, comprising:

applying a brazing material to a surface of a graphite structure;

brazing the brazing material and the graphite structure to form a brazing layer on the surface of the graphite structure;

soldering a metal sheet to the brazing layer;

forming a plurality of grooves in the graphite structure and metal sheet, such that the graphite structure and metal sheet form a plurality of commutator bars electrically insulated from each other.

2. The method of claim 1, wherein prior to applying a brazing material to a surface of a graphite structure, performing at least one of the following: grinding the surface of the graphite structure, cleaning the graphite structure in alcohol via ultrasonic waves, immersing graphite structure in acetone, and drying the graphite structure.

3. The method of claim 1, wherein applying a brazing material to a surface of a graphite structure includes screen printing the brazing material on the surface of the graphite structure.

4. The method of claim 3, wherein screen printing the brazing material includes using a polyester mesh having a thickness of 0.5 millimeter or less.

5. The method of claim 1, wherein applying a brazing material to a surface of a graphite structure includes spraying the brazing material onto the surface of the graphite structure.

6. The method of claim 1, wherein brazing the brazing material and the graphite structure comprises placing the graphite structure having the brazing material applied thereon into an environment having a vacuum degree of at least $1.0\times10^{-1}$ Pascal and a predetermined temperature of at least 800 degrees Celsius (° C.).

7. The method of claim 6, wherein brazing the brazing material and the graphite structure further comprises increasing the temperature of the environment at a rate between 10° C. and 20° C. per minute until the predetermined temperature is reached.

8. The method of claim 1, wherein brazing the brazing material and the graphite structure comprises brazing the brazing material and graphite structure in a protective atmosphere furnace having a temperature of at least 800° C.

9. The method of claim 8, wherein brazing the brazing material and the graphite structure further comprises filling the protective atmosphere furnace with nitrogen, hydrogen, argon, helium, carbon monoxide, carbon dioxide, ammonia decomposition, or a combination thereof.

10. The method of claim 1, wherein soldering the metal sheet to the brazing layer comprises:

applying a solder material to a surface of the brazing layer;

placing the metal sheet over the solder material; and placing the graphite structure and metal sheet into an environment having a temperature between 130° C. and 350° C. for between 2 minutes and 10 minutes.

11. The method of claim 10, wherein applying a solder material to a surface of the brazing layer includes placing a solid sheet of the solder material having a shape corresponding to a shape of the graphite structure to the surface of the brazing layer.

12. The method of claim 10, wherein applying a solder material to a surface of the brazing layer includes applying a solder paste or solder powder on the surface of the brazing layer.

13. The method of claim 10, wherein applying a solder material to a surface of the brazing layer includes screen printing the solder material onto surface of the brazing layer.

14. The method of claim 13, wherein screen printing the solder material includes printing through a steel mesh having a thickness of 1 millimeter or less.

* * * * *